United States Patent [19]

Cooperrider

[11] 4,424,793

[45] Jan. 10, 1984

[54] POWER GAS BURNER

[75] Inventor: Myron T. Cooperrider, North Royalton, Ohio

[73] Assignee: R. W. Beckett Corporation, Elyria, Ohio

[21] Appl. No.: 455,476

[22] Filed: Jan. 4, 1983

Related U.S. Application Data

[63] Continuation of Ser. No. 159,948, Jun. 16, 1980, abandoned.

[51] Int. Cl.[3] ..... F24H 3/02

[52] U.S. Cl. ..... 126/110 B; 126/110 C; 432/222

[58] Field of Search ..... 126/110 B, 110 C, 110 D, 126/116 R; 432/222; 431/285, 284, 350, 351, 352, 354; 60/738, 748, 751

[56] References Cited

U.S. PATENT DOCUMENTS

| | | | |
|---|---|---|---|
| 2,757,662 | 8/1956 | Baier et al. | 126/110 B |
| 2,776,654 | 1/1957 | Johnston | 126/110 B |
| 2,966,347 | 12/1960 | Wolffradt | 126/110 B |
| 3,193,265 | 7/1965 | Cowan | 432/222 |
| 3,384,070 | 5/1968 | Castello et al. | 126/110 B |
| 3,650,477 | 3/1972 | Gulliksson | 431/351 X |
| 3,689,040 | 9/1972 | Reich | 432/222 |
| 4,244,349 | 1/1981 | Velie et al. | 126/110 C |

*Primary Examiner*—Samuel Scott

*Assistant Examiner*—Randall L. Green

*Attorney, Agent, or Firm*—Pearne, Gordon, Sessions, McCoy, Granger & Tilberry

[57] ABSTRACT

A power gas burner of the gun type. The burner embodies an air tube that is mounted on the appliance with which the burner is to be used. Primary and secondary air is supplied to the air tube by a blower of the turbo-compressor type that is driven by a motor through an adjustable speed drive. Fuel gas is supplied to the air tube through an eductor tube. Gas is supplied to the eductor at regulated pressure through a metering orifice. The discharge end of the eductor is open and is located on the axis of the air tube and in the throat of a venturi that is also mounted on the axis of the air tube. Air supplied by the blower flows at high velocity through the throat of the venturi on the exterior of the eductor, resulting in a reduction in pressure in the venturi at the discharge end of the eductor. This primary air is mixed in the venturi with gas discharged from the eductor. A flame retention burner head is disposed at the discharge end of the air tube and the mixture of primary air and gas is discharged through the center of the burner head. Secondary air flows around the venturi in the air tube and is discharged through the outer portions of the burner head. A spark igniter is provided for igniting the primary air-fuel mixture near the burner head. The flame propagates outwardly, mixing with the secondary air downstream of the burner head.

1 Claim, 11 Drawing Figures

Fig. 1
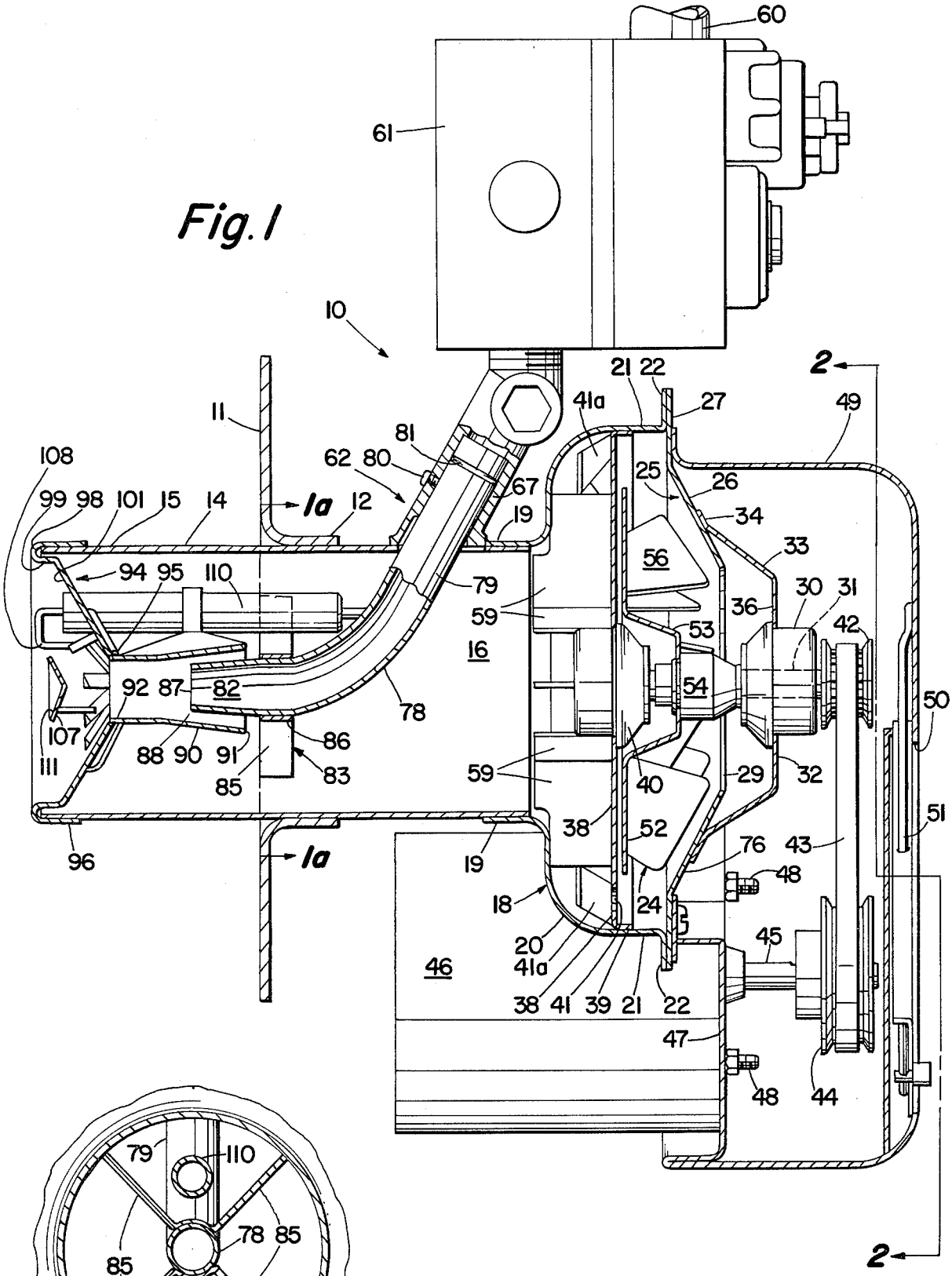
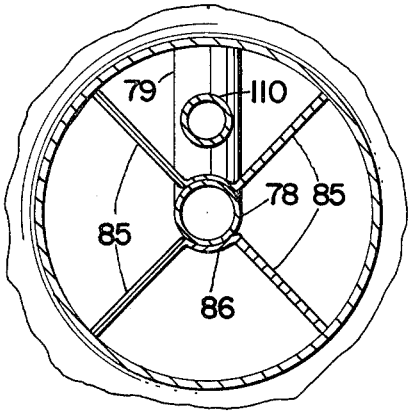
Fig. 1a

POWER GAS BURNER

This is a continuation, of application Ser. No. 159,948, filed June 16, 1980, now abandoned.

BACKGROUND OF THE INVENTION

1. Field of the Invention

This invention relates to power gas burners of the gun type. The invention is disclosed herein as it may be applied to gas burners of the type that may be utilized with domestic heating furnaces and other domestic appliances having capacities not in excess of about 400,000 B.t.u. per hour. It is to be understood, however, that the invention may be adapted to other services and uses and to burners of greater capacity.

2. Description of the Prior Art

Power gas burners of the gun type are well known in the art. Such burners embody an air tube and a blower which supplies both primary and secondary combustion air to the burner. The primary air is supplied to a mixing means where it is mixed with the gas which is supplied at a regulated pressure, the mixing means ordinarily being disposed within an air tube to which the secondary air is supplied by the blower. Prior burners have employed blowers of the squirrel cage type that produce a pulsating discharge with a resultant pulsating flame and noise, and a reduced combustion efficiency as compared to non-pulsating flames.

The present invention relates to burners of the flame-retention type embodying a flame-retention burner head disposed at or near the end of the air tube. The fuel, which has been mixed with the primary air, is discharged from the mixing means at or near the burner head and is ignited immediately downstream of the burner head. The burner head creates a zone in which the forward velocity of the air and fuel mixture is less than the rate of flame propagation. The base of the flame remains adjacent to the burner head. A burner head of this type is disclosed and claimed in my copending application Ser. No. 092,221, filed Nov. 7, 1979, now U.S. Pat. No. 4,278,406 which specifically discloses an oil burner embodying a burner head of this type.

Power gas burners are advantageous as compared to conventional gas burners in which natural draft is relied upon to supply the secondary air and in which the mixing of the gas with the primary air is accomplished by the velocity of the gas as it is discharged from an orifice connected to a supply of gas under presssure. If power gas burners are accurately controlled, they are able consistently to provide mixtures of fuel and air at very near stoichiometric proportions and in this respect they are superior to atmospheric burners. The more accurate proportioning of gas and air flow results in higher combustion temperatures and reduces the number of square feet of heat transfer surface required for a given capacity as compared to atmospheric burners. The proper proportioning of air and gas supply also increases the rate of combustion, reduces the size of the flame, and reduces the residence time of the gas and air in the flame. These factors all combine to reduce contaminants in the flue gases such as CO and $NO_x$.

A power gas burner of the gun type is illustrated in the Delancey and Cooperrider U.S. Pat. No. 3,820,943, issued June 28, 1974. This patent illustrates a burner embodying a conventional squirrel cage type blower which discharges air into an air tube. Gas is supplied by a tube leading to the center of the air tube and the velocity pressure at the periphery of the blower wheel, rather than the static pressure in the air tube, is utilized by means of a scoop that deflects air into the gas tube through a slot in the wall thereof. The gas is thus partially premixed with the air that is deflected by the scoop into the gas tube. This patent also discloses a burner head disposed at the end of the air tube. The burner head is centrally apertured to receive the end of the gas tube.

The Levey et al U.S. Pat. No. 2,077,424 illustrates a pressure gas burner having a conventional proportional mixer of the inspirator type for mixing the primary air with the gas. A burner head having primary air-fuel mixture ports and secondary air ports is illustrated. The mixer supplies a rich mixture of primary air and fuel to the burner ports. This burner depends upon the velocity of the gas emitted from a nozzle into the mixer to mix the gas and primary air, and would be sensitive to changes in atmospheric and combustion chamber pressures. The patent contemplates that changes in the ratio of primary air to fuel will take place, and these changes are said to be compensated for by corresponding changes in the quantity of secondary air made available. Other power gas burners are illustrated, for example, in the Conway U.S. Pat. No. 3,180,394, issued Apr. 27, 1965, the Vorheis et al U.S. Pat. No. 3,391,981, issued July 9, 1968, and the Wolffradt U.S. Pat. No. 2,966,347, issued Dec. 27, 1960.

In general, the prior art patents of which I am aware do not appear to provide burners that will operate at substantially constant air-fuel ratios under varying conditions, nor are the prior art burners readily adaptable to efficient operation under different firing rates and in conjunction with different types and sizes of furnaces.

SUMMARY OF THE INVENTION

A general object of the present invention is to provide an improved power gas burner of the gun-type that minimizes the difficulties encountered with prior types of gas burners.

Another object is the provision of a gas burner in which the air-fuel ratio can be accurately adjusted to firing requirements and in which the air-fuel ratio, once adjusted, is maintained substantially constant under varying atmospheric conditions.

Another object is to provide a burner which readily can be adapted to different rates of firing and different installation conditions, whereby a single basic design or type of burner can be utilized in installations of different sizes and types.

Other objects include the provision of power gas burners that are efficient in service and in which pulsations of the flame are substantially eliminated, whereby burner noise is reduced and burner efficiency is increased, and the provision of such a burner that can be manufactured and installed at reasonable cost and which will operate efficiently over long periods of time without requiring any substantial amount of service.

According to the present invention, these and other objects are attained by the provision of a gas burner having an air tube that is mounted on the wall or housing of the furnace or other appliance with which the burner is to be used and which acts as a support for the remaining components of the burner. Air is supplied to the air tube by a blower of the turbo-compressor type that produces a non-pulsating flow of air. The blower is driven by an electric motor through a conventional adjustable speed drive by a non-slip belt; one of the pulleys of the drive is adjustable in diameter to permit speed adjustment and the motor mounting is adjustable so that the belt can be maintained at the proper tension.

Gas is supplied to the air tube through a gas tube or eductor having an end portion that is coaxial with the air tube, and a laterally displaced portion that is connected to a gas supply through a conventional pressure regulating valve and a metering orifice. The plate in which the orifice is formed is disposed outside of the air tube in a readily accessible location so that the orifice plate can be changed quickly and easily to obtain the desired rate of flow of gas in the eductor tube.

The downstream end of the eductor is open and is located on the axis of the air tube in the throat of a venturi that is also mounted on the axis of the air tube. The pressure of air in the air tube created by the blower results in a high velocity flow of air through the venturi on the exterior of the gas tube or eductor, with a consequent reduction in pressure in the venturi at the discharge end of the eductor. The primary air is mixed in the venturi with the gas discharged from the metering orifice into the eductor. The venturi discharges this mixture through the center of the burner head, secondary air supplied by the air tube being discharged through the outer portions of the burner head. An electrode is provided for igniting the primary air-fuel mixture near the burner head and the flame propagates outwardly, mixing with the secondary air to provide a flame in the combustion zone of the furnace or other appliance, the base of the flame being close to the burner head.

The construction is such that the air-fuel ratio can be accurately controlled by installing an orifice of the desired size in the gas tube, controlling the pressure of the gas supply to the tube, and controlling the speed of the blower by means of the variable speed drive from the motor. The blower supplies a non-pulsating flow of air, resulting in quiet and efficient combustion of fuel, and the location of the discharge end of the eductor tube in the throat of the venturi ensures that the pressure in the eductor tube near the metering orifice will remain substantially constant regardless of changes in atmospheric pressure or changes in combustion chamber pressure and the like within normal ranges. The result is that the air-fuel ratio remains substantially constant under variations in operating conditions of the burner within ordinary limits.

BRIEF DESCRIPTION OF THE DRAWINGS

In the drawings, which illustrate a preferred form of power-gas burners embodying the invention;

FIG. 1 is a vertical, sectional view of a burner embodying the invention, the section being taken along the axis of the air tube;

FIG. 1A is a fragmentary, sectional view taken on the line 1A—1A of FIG. 1;

DESCRIPTION OF A PREFERRED EMBODIMENT

Figure 2:
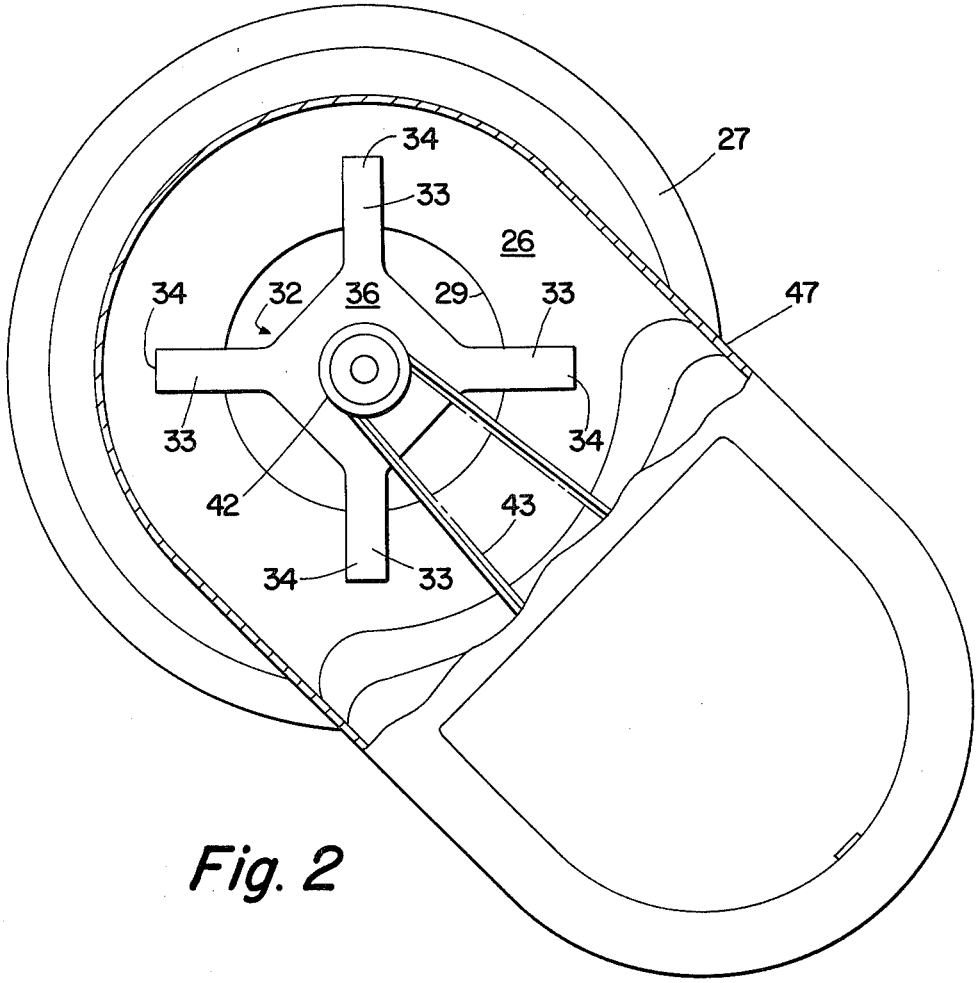
FIG. 2 is a fragmentary, vertical section taken as indicated by line 2—2 of FIG. 1 and with part of the housing of the blower broken away for the purpose of illustration.

A preferred type of power gas burner embodying the invention is indicated in general at 10 in FIG. 1 of the drawing. As there shown, the entire assembly is arranged to be supported by a flange 11 having an axially extending portion 12 that may be welded, bolted, or otherwise secured to the exterior of the air tube 14 of the burner. If desired, portion 12 may be adjustably secured to the air tube, as by setscrews, so that the flange may be disposed in a desired position with respect to the end 15 of the air tube. The flange 11 may be secured to the wall of a furnace or other appliance with which the burner is to be used by any convenient means, with the discharge end 15 of the air tube projecting into the combustion chamber of the appliance.

The remaining components of the burner are preferably supported on the exterior of the appliance by the inlet end portion 16 of the air tube. To this end, a hollow housing member 18 of generally circular cross section is provided with a flange 19 that is welded, bolted, or otherwise secured to the exterior of the air tube 14 adjacent the inlet end thereof. Housing 18 constitutes the rear portion of a blower housing and has a curved, outwardly extending portion 20 that merges into an axially extending cylindrical portion 21 that terminates in a radially outwardly extending flange 22.

Air is supplied to the air tube by a turbo blower having a rotor 24 that is disposed in the cylindrical portion 21 of the housing member 18 remote from the air tube. The blower is enclosed by a front blower housing member 25 having a conical body portion 26 terminating in a flange 27 that is secured to the radial flange 22 of the housing 18. The conical body portion 26 has a central aperture 29 through which inlet air can flow to the blower rotor 24.

In order to support the front bearing 30 for the shaft 31 of the blower, there is provided a bearing support 32 having four radially extending legs 33 (see FIG. 2). The ends 34 of legs 33 are welded to the conical portion 26 of the front blower housing 25. The bearing support 32 is centrally apertured to receive the bearing 30, which is clamped to the central portion 36 of the support 32 surrounding the aperture.

Figure 4:
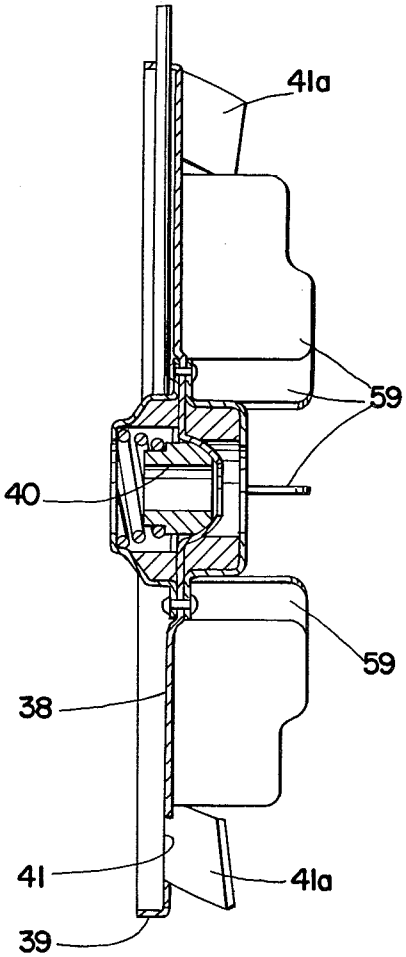
FIG. 4 is a section taken along line 4—4 of FIG. 3.
Figure 3:
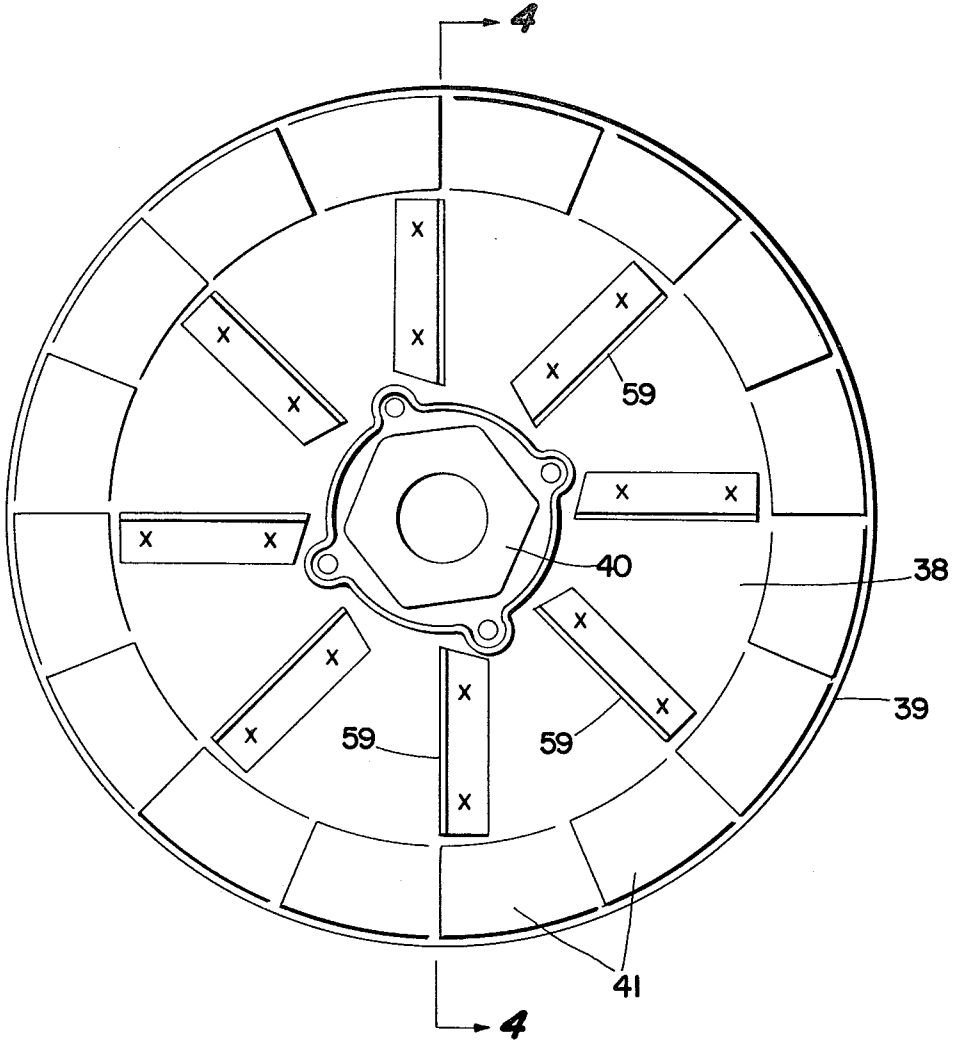
FIG. 3 is an elevational detail of a diffuser plate and bearing support that is associated with the blower of the burner.

In order to support the inner end of the blower shaft 31, a transversely extending diffuser plate 38 (FIGS. 1, 3, and 4) is supported by an axially extending flange 39 that is welded to the axially extending portion 21 of the rear blower housing 18, a bearing unit 40 being suitably supported in an opening in the diffuser plate 38. The diffuser plate 38 has a plurality of circumferential slots 41 and tongues **41*a* formed therein in an annular zone around its circumference to direct the air flow from the blower in the desired direction. Also, eight radial straightening vanes 59 are welded to the plate 38 inwardly of the slots 41 to reduce swirling movement of the air flow passing through the slots 41 and to reduce turbulence. The rearward end of this blower shaft 31 is journaled in the bearing 40**.

In order to drive the blower, a pulley 42 is mounted on the outer end of the shaft 31 and is driven by a belt 43. Belt 43 is driven by a driving pulley 44 mounted on the shaft 45 of a conventional motor disposed within motor housing 46. Both pulleys and the belt are preferably of the non-slip type, providing a positive drive for the blower. The diameter of the pulley 44 is preferably adjustable by conventional means so that by varying the diameter of drive pulley 44, the speed of rotation of the shaft 31 and impeller of the blower can be varied. To accommodate this, the motor is supported on a supporting plate 47 that, in turn, is adjustably support from the flange 22 of the rear housing member 19 in a known or conventional fashion. The motor is supported and retained in its adjusted position by bolts 48 that engage the motor frame and the support member 47.

The pulleys 42 and 44, the belt 43, and associated mechanisms are enclosed by an inlet air housing 49 that is secured to the radial flange 27. Inlet air housing 49 has an air inlet opening 50 to admit air to the blower housing. The size of this opening may be controlled by any conventional mechanisms, such as indicated at 51.

Figure 5:
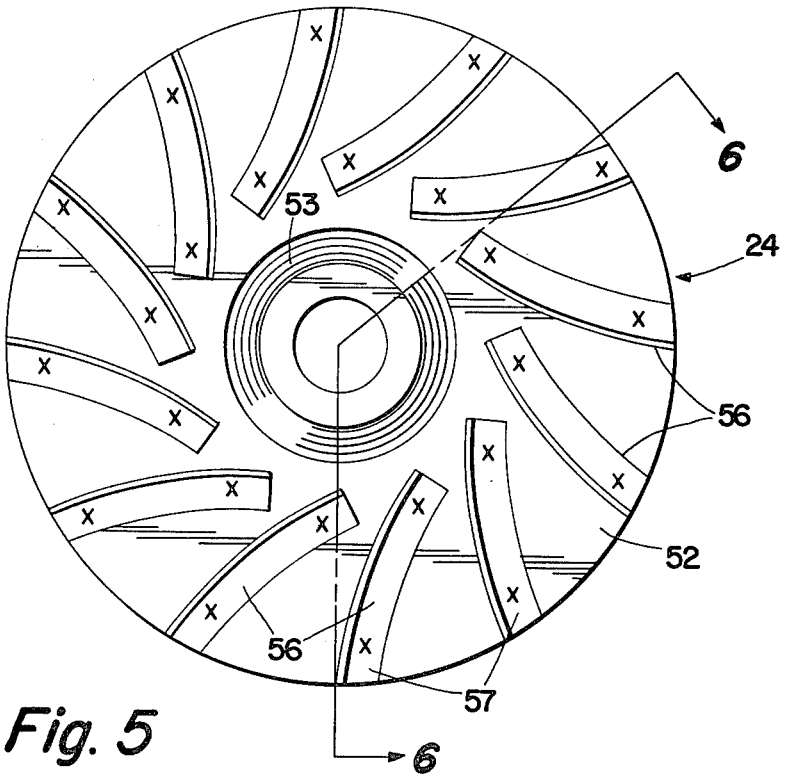
FIG. 5 is an elevation and FIG. 6 is a section with parts broken away of a preferred form of rotor for the blower, shown separately from the burner.
Figure 6:
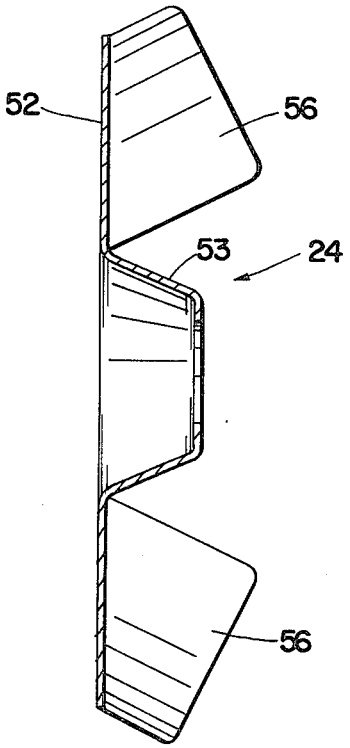

As shown particularly in FIGS. 1, 5, and 6, the blower 24 is of the turbo-compressor type and comprises a base plate 52 having an outwardly extending hub portion 53 that is secured to the shaft 31 to be driven thereby through a conventional type of connecting fitting 54. The blower embodies a plurality of rearwardly curved vanes 56 each having a foot portion 57 that is secured to the base plate 52 as by spot welds 58, some of which are diagrammatically illustrated in FIG. 5.

When the blower is in operation, the rotor 24 is driven at the desired speed by the motor through the drive pulley 44, belt 43, and pulley 42. Air flows into the inlet air housing 49 through the opening 50, and reaches the impeller 24 through the spaces between the legs 33 of the bearing support 32 and through the opening 29 in the front blower housing 26. Rotation of the rotor 24 causes the backwardly sloped vanes 56 to move the air radially outwardly into an annular chamber surrounding the rotor. The air then flows past the peripheral edge of the base plate 52 through the slots 41 in the diffuser plate 38, past straightening vanes 59 and into the end 16 of the air tube 14.

The provision of a blower of the turbo-type with backwardly curved impeller blades 56, together with the diffuser plate 38 and straightening vanes 59, ensures the delivery of air to the air tube 14 in a condition where it is substantially free of pulsation and without any substantial swirling motion. The absence of pulsations and swirling motion, as explained below, results in quiet and efficient combustion of the gas and uniform mixing of the gas with both the primary and secondary air. This ensures efficient combustion with almost entire elimination of any hazardous or contaminating flue gases. In addition, blowers of the turbo-compressor type are more energy-efficient than squirrel cage blowers.

Fuel gas is supplied to the burner from a conduit 60 (FIG. 1) leading from any convenient source. Natural gas, liquefied petroleum gas, or various synthetic gases may be utilized with the burner. Conduit 60 is connected to a gas control unit 61, which may be of known conventional construction, embodying an electrically operated flow control valve and an adjustable pressure regulator of known types. The flow control valve is operated in accordance with electrical signals which may be received from a thermostat within the space being heated and also from the burner itself, as explained below. The pressure regulator may be adjusted to comply with the requirements of the fuel being burned, the conditions under which the burner is operated, and similar factors. In this connection, however, it is to be noted, as described below, that with the present burner, after the initial adjustment it is seldom necessary to make further adjustments of the pressure. For example, with a proper flow control orifice, burners according to the invention operate efficiently at gas pressures of about 3.5 inches of water, with either natural gas or liquefied petroleum gas.

Figure 9:
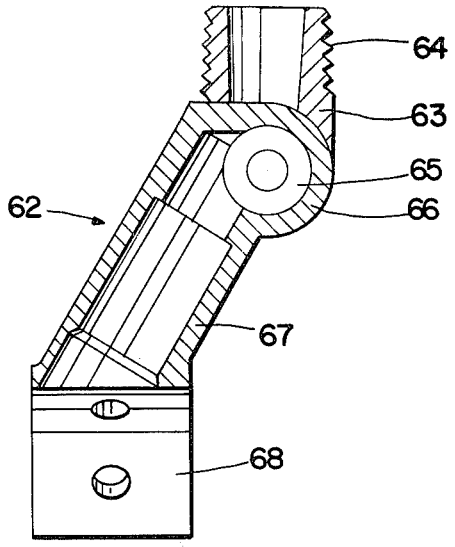
FIGS. 9 and 10 are sectional details to an enlarged scale, illustrating a flow control fitting whereby a metering plate may be readily interchanged in order to provide the desired rate of gas flow to the eductor.
Figure 10:
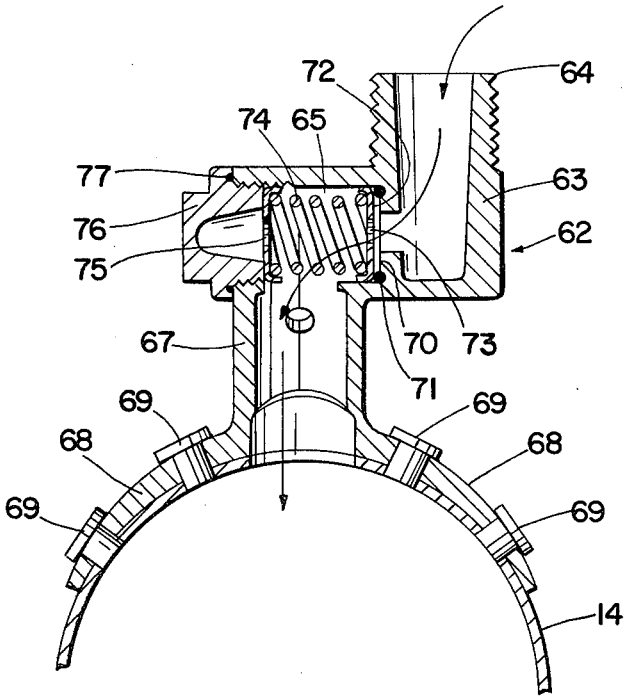

The control unit 61 is supported by and discharges into a support and flow control fitting, indicated in general at 62 and shown in FIGS. 1, 9 and 10. Fitting 62 comprises an inlet portion 63 connected to the control unit 60 by its threaded end 64. The inlet portion leads to a metering chamber 65 formed within a projection 66 formed integrally with the inlet portion, and also formed integrally with a discharge portion 67 that terminates in an arcuate supporting saddle 68. The saddle 68 is shaped to conform to the exterior of the air tube 14 and is secured to the air tube by screws 69 that are threaded into appropriate openings in the wall of the air tube.

In order to meter the flow of gas through the fitting 62, an annular seat 70 is provided between the inlet portion 63 and the metering chamber 65 of the fitting 62. The seat provides a support for an O-ring 71 against which a metering plate 72 having a metering orifice 73 is urged by a spring 74, the other end of which engages a spare metering plate 75 that is supported by a closure cap 76, an O-ring 77 being provided to prevent leakage between the cap and the end of the metering chamber 65.

With this arrangement, it is possible to utilize a simple stamping as a metering plate. Since the fitting 62 is disposed on the exterior of the burner, the cap 76 is readily accessible and metering plates can be replaced or interchanged with little difficulty. The metering plate 75 can be a duplicate spare plate, or can be a plate having a different size orifice for use with a different type of gas, if that appears to be required.

Gas passing through the orifice 73 is supplied to the air tube 14 through an eductor tube 78, the outer or inlet end 79 of which telescopes into the bore of the discharge portion 67 of the fitting 62, being retained in a desired position of adjustment by setscrew 80, an O-ring 81 disposed in a groove of the outer end 79 of the eductor being provided to prevent leakage. It will be noted that the internal diameter of the eductor is a good many times the diameter of the metering orifice 73. The velocity of flow of gas in the eductor is only a fraction of the velocity of the flow through the metering orifice.

The eductor 78 is preferably bent as shown and has an axially extending, inner discharge portion 82 which is disposed on the axis of the air tube 14. The portion 82 of the eductor is retained in position by a centering spider 83 having four angularly spaced legs 85 terminating in inner, arcuate portions 86 that are welded to the outer surface of the eductor 78. The outer end portions of the legs 85 engage the inner diameter of the air tube 14. Thus, the eductor tube is accurately held in its desired position on the axis of the air tube.

The discharge end 87 of the eductor is open, as shown, and terminates within the throat 88 of a venturi 90. Preferably the end portion of the eductor is slightly tapered, as shown in FIG. 1. In general, however, the internal diameter of the eductor is substantially uniform throughout, except for the slight taper near the end. With this arrangement, when the gas valve is open, permitting discharge of gas into the eductor through the orifice plate 72, and when the blower is in operation, the air pressure within the air tube 14 will be substantially above atmospheric pressure and above the pressure in the combustion chamber into which the air tube discharges. Air will flow at high velocity through the annular passage between the entry end 91 of the venturi and the exterior of the discharge end 82 of the eductor tube into the throat of the venturi. The high velocity of the air in the venturi results in a reduction in pressure at the end 87 of the eductor tube; this reduced pressure is reflected through the eductor tube back to the orifice plate. Because of this arrangement, changes in external atmospheric pressure and changes in the pressure in the combustion chamber of the appliance have little if any effect on the rate of discharge of gas through the orifice plate for a given gas pressure, and ordinary variations in pressure within the combustion chamber have little, if any, effect on the volume of air that flows through the venturi throat in a given period of time. Thus, once the air-fuel ratio is adjusted to a desired value by adjusting the speed of the blower or by adjusting the area of the inlet air opening 50 and by selection of a proper orifice plate, that valve will remain substantially constant regardless of changes in atmospheric pressure and in combustion chamber pressure that are within the normal ranges.

A possible reason for this is that if the pressure in the combustion chamber into which the gas and air mixture is discharged should increase, the volume of air and the velocity of air flowing through the venturi would decrease slightly. Because of the decrease in velocity of air flowing through the venturi, there would be less reduction of pressure at the end 87 of the eductor tube and the pressure at the discharge side of the metering orifice would increase slightly, reducing the volume of gas discharged through the orifice. These two effects tend to counteract each other, thus maintaining the air-fuel ratio substantially constant. A similar action takes place if the pressure in the combustion chamber should decrease. In that case, the volume of air and the velocity of the air flowing through the venturi would increase slightly and the increased velocity of air would cause a greater reduction of pressure at the end 87 of the eductor tube and on the discharge side of the metering plate 72. Thus, both the volume of gas and the volume of air mixed at the venturi would be slightly increased and the ratio of primary air to fuel would remain substantially constant. Also, the changes in combustion chamber pressure that occur in normal operation are slight compared to the discharge pressure of the blower, and therefore have little effect on the air-fuel ratio.

Other advantages flow from the present invention in which the fuel gas is discharged from an eductor tube in the throat of the venturi, air being supplied to the venturi by a blower. This construction, in which the energy required for mixing primary combustion air with the fuel gas is derived principally from the blower rather than from the pressure of the gas, has an unexpected advantage in that it makes it possible readily to adapt burners embodying the invention to different kinds of gaseous fuels without requiring extensive modification of the burner. For example, atmospheric gas burners and prior types of power gas burners firing at rates of less than 400,000 B.t.u.'s per hour employ a venturi to premix part of the combustion air with the gas. In these prior burners, the gas discharging from the gas discharge orifice is at a higher velocity than the surrounding air. The high velocity gas entrains a portion of the combustion air, producing an air-fuel mixture that is in the combustible range when it leaves the burner head. The mixing of the secondary combustion air with the mixture of primary air and gas takes place after the primary gas-air mixture enters the combustion chamber.

In this prior arrangement, most of the energy for mixing the gas and the primary air is derived from the gas. Because of the different chemical and physical characteristics of different fuel gases, different orifices and different pressures are required for different gases. For example, in the usual atmospheric burners a regulated gas pressure of 3.5 inches of water ("W.C.) is employed for natural gas and 10" W.C. for liquefied petroleum gas where the combustion chamber pressure is subatmospheric.

Most power gas burners firing at rates of up to 400,000 b.t.u. per hour employ orifices and venturis similar to those employed in conventional atmospheric burners. In these prior burners, the venturi and the orifice are surrounded by air in the air tube that is above atmospheric pressure. This pressure forces primary air through the venturi for partial premixing with gas, the balance of the combustion air passing around the outside of the venturi. The static pressure in the air tube reduces the flow rate of a given diameter orifice as compared to the rate through the same orifice in an atmospheric burner. The higher the air tube pressure, the lower the rate of flow through an orifice of a given diameter at a given gas pressure. In these burners, it is necessary to use a 10" W.C. regulated gas pressure with liquefied petroleum gases because these gases require smaller orifices because of the higher b.t.u. content per cubic foot of gas. If the usual 3.5" W.C. pressure were employed, the resulting smaller diameter gas stream at relatively low velocity would not be able to induce an adequate volume of primary air for good premixing. When 10" W.C. is used the increased gas velocity induces an adequate quantity of primary air for acceptable premixing in the venturi. In burners of this general type, the venturi and the orifice are surrounded by air that is above atmospheric pressure. Increases in the air tube pressure increase the flow of air through the air tube and reduce the rate of flow of gas for an orifice of a given diameter, thus increasing the air-fuel ratio. Decreases in air tube pressure decrease the volume of air flowing through the air tube and increase the rate of flow of gas for an orifice of a given diameter, thus decreasing the air-fuel ratio.

The operation of the present burner is quite different from prior types of burners embodying conventional venturis in which the air-fuel ratio can vary substantially because of changes in air tube pressure and rates of air flow. In the burner of the present invention, the pressure in the eductor is always quite near atmospheric when gas is flowing through the eductor tube. When the gas valve is shut off with the burner blower running, the eductor tube pressure is always below atmospheric pressure. This subatmospheric pressure is created by the air flowing through the venturi at high velocity. The high velocity air passing the open end 87 of the eductor creates a subatmospheric pressure inside of the eductor. For example, in a typical burner if the air tube pressure is 0.4" W.C. above atmospheric, the eductor tube pressure with the gas valve shut off will always be approximately 0.2" W.C. below atmospheric pressure. For a given venturi and eductor, the ratio of air tube pressure to eductor pressure with the gas valve shut off remains the same for any given air tube pressure within the usual range.

If the volume of air discharged by the blower is increased while the gas valve is open, the only effect on the discharge of gas from the eductor is that the volume of gas discharged may be slightly increased because the increased velocity of air flowing through the venturi results in a slight reduction of pressure in the eductor tube, and this reduction in pressure slightly increases the flow of gas through the metering orifice. On the other hand, if the volume of air discharged by the blower is reduced, the lower velocity of air at the end of the eductor results in a slight increase in pressure in the eductor (the reduction in pressure at the open end of the eductor is lessened), thus slightly reducing the flow of gas through the metering orifice. These effects tend to maintain the air-fuel ratio constant even though the volume of air supplied to the burner may vary.

The burner of the present invention, therefore, can be adapted to different firing rates within a reasonable range and adapted to different types of gaseous fuels simply by utilization of a proper orifice plate in the fuel supply and adjustment of the speed of the blower or the air inlet opening to provide the desired air-fuel ratio. Changes in the flow of gas from a given orifice resulting from changes in pressure in the air tube are minor and such changes as may take place are such as to tend to maintain the air-fuel ratio substantially constant. As explained above, this desirable result is contrary to the resuilts obtained with burners using conventional venturis in which changes in air tube pressure can result in undesirable changes in air-fuel ratio.

Figure 7:
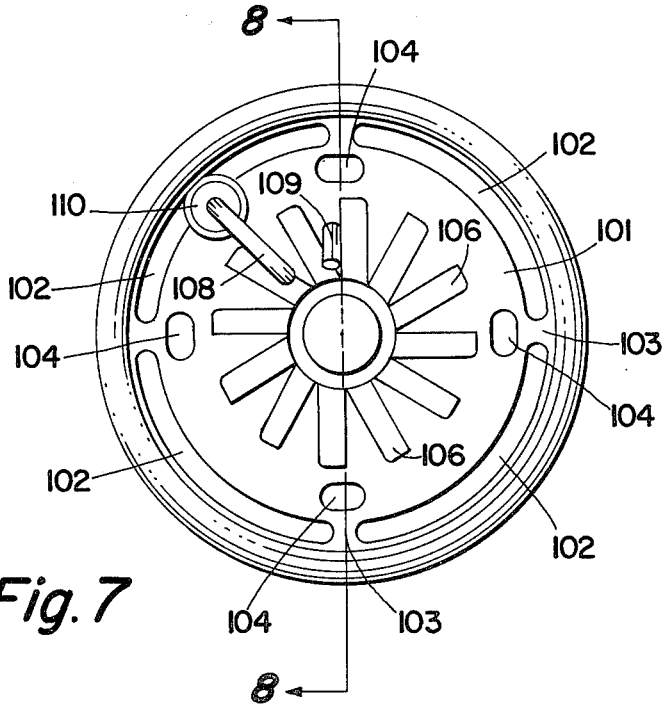
FIG. 7 is an end elevational view of the discharge end of the air tube, illustrating the flame retention head and associated parts.
Figure 8:
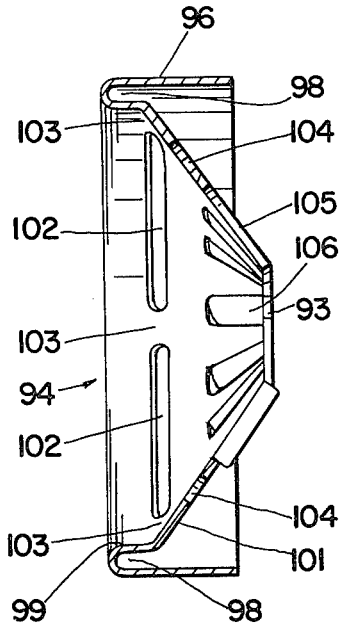
FIG. 8 is a sectional view of the flame retention head removed from the air tube, taken on the line 8—8 of FIG. 7.

In order to support the venturi 90 in the air tube 14, the downstream end 92 of the venturi is secured as by welding to the inner edge of a circular opening 93 in the flame retention head 94, as indicated at 95. The flame retention head 94 (FIGS. 1, 7 and 8) has an axially extending flange 96 which accurately fits the exterior of the end 15 of air tube 14 and is secured to the air tube as by a setscrew. The flame retention head is accurately centered with respect to the air tube by the flange 96 and the venturi 90 is accurately positioned with respect to the flame retention head 94 by being welded thereto. The venturi is thus accurately located on the axis of the air tube and is concentric with the end 87 of the eductor.

The eductor and the venturi provide a combustible mixture of fuel and primary air that is discharged through the central opening in the flame retention head 94. Secondary air provided by the blower flows within the air tube 14 around the venturi 90 and through the flame retention head 94. The flame retention head serves to mix secondary air with the mixture of fuel and primary air discharged from the venturi, as well as to retain the flame near the downstream surface of the flame retention head. To this end, the flame retention head is preferably constructed and arranged as disclosed and claimed in my aforesaid copending application Ser. No. 092,221, filed Nov. 7, 1979, to which reference is hereby made. The flame retention head 94 comprises an accurate one-piece stamping. The dies that form the stamping ensure accuracy in the completed product. As noted above, the head is centered with respect to the air tube 14 by the axially extending flange 96 that slugly engages the exterior of the air tube 14. Directly within the flange 96, the periphery of the head is formed with an annular channel 98 having an inner cylindrical flange 99 projecting inwardly a short distance from the outer end of the air tube. At the inner end of the flange 99, the head has a conical portion 101 that extends inwardly and upstream toward the axis of the air tube.

A short distance from the juncture of the flange 99 and the conical portion 101 four circumferentially extending arcuate slots 102 are formed in the conical portion. The slots all have the same radius and width and are concentric with the axis of the air tube. Adjacent ends of the slots are spaced a short distance from each other to leave integral webs or struts 103 between the slots to support the remainder of the flame retention head. The arcuate slots 102, which extend throughout nearly all of the circumference of the air tube and the flame retention head, permit the flow of a generally cylindrical blanket of air in an axial direction from the air tube into the combustion zone, furnishing additional air to the fuel-air mixture near the flame retention head.

In order to ensure that this blanket of air will be substantially uniform throughout its circumference, and to substantially eliminate the distortions that might otherwise occur because of the presence of the struts 103, openings 104 are provided in the conical portion 101 of the flame retention head radially inwardly from the struts 103. Preferably, the arcuate length of these openings 104 is at least substantially equal to the arcuate distance between adjacent ends of the slots 102, and the area of the openings is such as to substantially compensate for the obstruction to flow of air caused by the presence of the struts. The slots and openings provide apertures for the flow of air throughout the entire circumference of the head. Thus, air passing through the openings 104 completes the circumferential blanket of air provided by the arcuate slots 102.

In order to provide the desired highly turbulent vortexing flow of air immediately downstream of the head 94, slits 105 are provided in the conical portion 101 of the head. These slits preferably lie in planes parallel to the common axis of the air tube 14 and the flame retention head. The formation of the slits leaves vanes 106 between them. The vanes are twisted slightly in the same direction by uniform amounts, thus providing passages for flow of air between adjacent vanes. In a typical retention head, the slits may be about 1/16 of an inch in width. Air flowing through the head is caused to rotate in a generally helical pattern downstream of the head by the action of the vanes. The inner ends of the vanes define the circular opening 93 that is concentric with the air tube and to which the venturi 91 is welded.

As noted above, the venturi discharges a combustible mixture of fuel and primary air through the opening 93 defined by the inner ends of the vanes. This mixture is deflected outwardly by a conical sheet metal deflector 107, the deflector being coaxial with the air tube and its apex being directed upstream toward the open end of the venturi 91. The mixture of fuel and primary air discharged from the venturi is deflected outwardly by the deflector 11 while secondary air flowing around the exterior of the venturi and through the slits 109 is caused to rotate in a generally helical pattern downstream of the head by the action of the vanes. The mixture of primary air and fuel encounters the vortexing air flow created by vanes, resulting in a thorough mixture of the fuel gas with both the primary and secondary air. Thus, in the combustion zone downstream of the burner head there is a vortexing flow of fuel and primary air created by the vortexes formed by each vane. The fuel and air in these vortexes not only rotates in the vortex, but the vortexes themselves travel downstream and rotate around the axis of the tube. A cylindrical envelope of secondary air flowing primarily in an axial direction is provided by the circumferentially extended slots 102 and the secondary intermediate openings 104 of the burner head. The interaction of these different flows produces rapid intermixing of the fuel and air and high velocity, highly turbulent flow of this mixture immediately downstream of the burner head.

The velocity of flow through the burner head is greater than the rate of flame propagation. Also, there is a high pressure drop across the burner head. These factors inhibit backfire. Furthermore, the fuel gas supply is remote from the combustion zone and backfire cannot travel up the eductor since the eductor does not contain a combustible mixture.

The arrangement provides an easily ignitable mixture of fuel gas and primary air adjacent the discharge end of the venturi. This is ignited by an ignition electrode 108 disposed adjacent a suitable grounding electrode. The electrode 108 is supported by an insulated lead 110 which extends through the wall of the air tube 14 to a conventional electric control (not shown) which supplies high voltage to create a spark when ignition of the primary fuel-air mixture is desired. Preferably, a known apparatus is employed which senses the presence of a flame around the sparking electrode. When the presence of a flame is detected, the sparking voltage is promptly shut off. If the fuel-air mixture is not ignited by the spark within a predetermined time, the electronic circuits close the gas valve, shutting off the supply of fuel to the burner. Thus, the discharge of fuel-air mixture into the combustion chamber in the absence of a flame is prevented, except for the few seconds that are required to initiate combustion.

When the mixture of fuel and primary air is ignited, this burning mixture is deflected outwardly into the stream of secondary air coming through the burner head and normal combustion continues, the secondary air rapidly mixing with the primary air so that combustion takes place rapidly and efficiently with the fuel and air present in substantially stoichiometric proportions. The rapid combustion results in the production of a flame of high temperature which provides for efficient transfer of heat to the walls of the furnace or other appliance and for very rapid combustion, which minimizes the production of $NO_x$.

As is customary, the carbon dioxide content of the fuel gases can be determined. Based on this determination the correct proportions of fuel and air can be secured by adjusting the speed of the blower by means of the variable ratio drive or by adjusting the air inlet opening 50. Once this adjustment has been carried out correctly, it seldom needs to be repeated in the absence of a change in the characteristics of the fuel gas being supplied to the burner. If a different fuel gas is supplied, a different orifice plate can be inserted in the gaseous fuel supply without disturbing the remaining portions of the burner and the speed of the blower and the inlet opening can be adjusted as required, all without requiring disassembly of the burner or any complicated adjustments.

From the foregoing description of a preferred form of my invention, it will be evident that the invention provides a simple, highly efficient burner that can be adapted for use with various kinds of fuel gases under various conditions, only simple adjustments and easy replacement of the orifice plate being needed to secure efficient clean combustion under a wide range of conditions and fuels. These features, which are simple and reliable, make burners made according to the invention readily adaptable to a wide variety of sizes and types of furnaces and other appliances.

Those skilled in the art will appreciate that various changes and modifications can be made in the invention without departing from the spirit and scope thereof. The essential characteristics of the invention are summarized in the appended claims.

What is claimed is:

1. A power fuel gas burner comprising:

an air tube having an inlet end and a discharge end, a venturi disposed within and coaxial with the air tube, the venturi having an entry portion of lesser diameter than the internal diameter of the air tube, the entry portion of the venturi tapering to a throat of reduced diameter as compared to the entry portion thereof, and a discharge end disposed near the discharge end of the air tube, an eductor tube for supplying fuel gas to the burner, said eductor tube having an open discharge end concentric with the venturi and disposed in the throat of the venturi, said eductor tube having an inlet end that is disposed outside of the air tube, means for supplying fuel gas to the inlet end of the eductor tube, said means including a pressure regulator and a removable and replaceable orifice plate interposed between said pressure regulator and said educator tube and located outside of said air tube, said orifice plate defining a metering orifice for controlling the rate of flow of fuel gas into the eductor tube, the cross-sectional area of the metering orifice being small as compared to the cross-sectional area of the open discharge end of the eductor tube, whereby the velocity of the fuel gas as it is discharged from the eductor tube is greatly reduced as compared to the velocity of the fuel gas as it is discharged from the metering orifice into the eductor tube, the fuel gas so supplied being discharged from the open discharge end of the eductor tube within the venturi, a turbo compressor-type blower for supplying air under greater than atmospheric pressure to the entry end of the air tube, a portion of the air supplied to the air tube by said blower flowing through the venturi and constituting primary combustion air, and the remaining portion flowing outside the venturi and constituting secondary air, the velocity of flow of air within the venturi being increased in the throat of the venturi and adjacent the open end of the educator tube whereby the pressure of the air adjacent said end of the eductor tube is reduced as compared to the pressure of air supplied to the air tube, the fuel gas supplied to the eductor tube being discharged through the open end thereof into this zone of reduced pressure and being mixed with the primary air supplied to the venturi, the mixture of fuel gas and primary air being discharged from the discharge end of the venturi, means immediately adjacent the discharge end of the venturi for igniting the mixture of primary air and fuel gas discharged from the venturi, and means including a flame retention head for mixing the mixture of primary air and fuel gas discharged from the venturi with said secondary air downstream from the discharge end of the venturi, said flame retention head having a frusto-conical shape and a central opening that is coaxial with the discharge end of the venturi, said opening being disposed upstream of the circumferential portion thereof that is secured to said air tube, said discharge end of said venturi being secured to the edge of said opening in the flame retention head.

* * * * *